US007040310B2

(12) United States Patent
Finstad

(10) Patent No.: US 7,040,310 B2
(45) Date of Patent: May 9, 2006

(54) PAINTBALL PROJECTILE DROP COMPENSATOR

(75) Inventor: Mark T. Finstad, Oak Grove, MN (US)

(73) Assignee: National Paintball Supply, Inc., Sewell, NJ (US)

( * ) Notice: Subject to any disclaimer, the term of this patent is extended or adjusted under 35 U.S.C. 154(b) by 0 days.

(21) Appl. No.: 10/453,122

(22) Filed: Jun. 3, 2003

(65) Prior Publication Data

US 2004/0123856 A1 Jul. 1, 2004

Related U.S. Application Data

(60) Provisional application No. 60/386,634, filed on Jun. 5, 2002.

(51) Int. Cl.
*F41B 11/00* (2006.01)

(52) U.S. Cl. ..... 124/81

(58) Field of Classification Search ..... 124/81, 124/83, 84

See application file for complete search history.

(56) References Cited

U.S. PATENT DOCUMENTS

| | | | | | |
|---|---|---|---|---|---|
| 1,187,218 | A | | 6/1916 | Wister | |
| 1,348,987 | A | | 8/1920 | Fischer | |
| 2,119,169 | A | | 5/1938 | Lauf | |
| 2,182,369 | A | * | 12/1939 | Barron | 124/81 |
| 2,345,089 | A | | 3/1944 | Born | |
| 3,101,028 | A | | 8/1963 | Berge | |
| 3,329,063 | A | | 7/1967 | Ehrenburg et al. | |
| 3,510,222 | A | | 5/1970 | Shaw | |
| 3,521,616 | A | * | 7/1970 | Chang et al. | 124/67 |
| 3,610,222 | A | * | 10/1971 | Hartman | 124/73 |
| 3,617,000 | A | | 11/1971 | Probst et al. | |
| 3,669,087 | A | | 6/1972 | Hamrick et al. | |
| 3,726,266 | A | | 4/1973 | Palmer | |
| 3,838,676 | A | * | 10/1974 | Kahelin | 124/75 |
| 3,917,265 | A | * | 11/1975 | Schrier et al. | 473/431 |
| 3,930,486 | A | * | 1/1976 | Kahelin | 124/72 |
| 3,989,027 | A | * | 11/1976 | Kahelin | 124/58 |
| 3,996,916 | A | | 12/1976 | Koehn et al. | |
| 4,073,280 | A | | 2/1978 | Koehn et al. | |
| 4,249,465 | A | | 2/1981 | Ballmann | |
| 4,250,862 | A | | 2/1981 | Speer | |
| 4,318,329 | A | | 3/1982 | Rentzsch et al. | |
| 4,323,047 | A | * | 4/1982 | McIntosh et al. | 124/1 |
| 4,335,701 | A | * | 6/1982 | Bozich | 124/26 |
| 4,345,578 | A | | 8/1982 | Speer | |
| 4,570,607 | A | * | 2/1986 | Stokes | 124/56 |
| 4,615,325 | A | * | 10/1986 | Yamamura et al. | 124/7 |
| 5,228,427 | A | * | 7/1993 | Gardner, Jr. | 124/71 |
| 5,337,504 | A | | 8/1994 | Krumm | |
| 5,337,726 | A | * | 8/1994 | Wood | 124/61 |
| 5,413,085 | A | | 5/1995 | Kraeft | |
| 5,450,838 | A | * | 9/1995 | Nakahigashi et al. | 124/56 |

(Continued)

*Primary Examiner*—Troy Chambers
(74) *Attorney, Agent, or Firm*—Volpe and Koenig, P.C.

(57) ABSTRACT

A barrel adaptor for a paintball gun is provided to induce spin onto a paintball exiting the barrel of the paintball gun thereby providing selected projectile drop compensation. The adapter consists of a structure having an elongated aperture with a first end adapted to fit snugly over the barrel of the paintball gun thereby extending the barrel. An exit portion of the adapter forms an open trough-like cavity, wherein the trough-like cavity is generally mal-aligned with the paintball gun barrel such that a spin is imparted upon a paintball fired from the paintball gun barrel as it passes longitudinally through the trough-like cavity and exits therefrom.

6 Claims, 10 Drawing Sheets

CROSS SECTION THROUGH ADJUSTMENT GUIDE HOLE
(ADJUSTMENT PIN INSTALLED)

U.S. PATENT DOCUMENTS 5,613,483 A 3/1997 Lukas et al.
5,634,456 A 6/1997 Perrone
5,640,945 A * 6/1997 Slonaker et al. ..... 124/56
5,701,878 A 12/1997 Moore et al.
5,735,256 A 4/1998 Monk
5,823,173 A * 10/1998 Slonaker et al. ..... 124/56
5,832,909 A * 11/1998 Grant et al. ..... 124/6
5,878,736 A 3/1999 Lotuaco, III
5,988,153 A * 11/1999 Yoshimura ..... 124/81
6,164,271 A * 12/2000 Paulson et al. ..... 124/78
6,324,779 B1 * 12/2001 Tippmann, Jr. ..... 42/76.01
6,364,737 B1 4/2002 Sterr et al.
6,520,172 B1 2/2003 Perrone
6,526,685 B1 3/2003 Tippmann
6,805,111 B1 10/2004 Tippmann
2001/0032638 A1 * 10/2001 Yoshimura ..... 124/81
2005/0091900 A1 5/2005 Tippmann

* cited by examiner

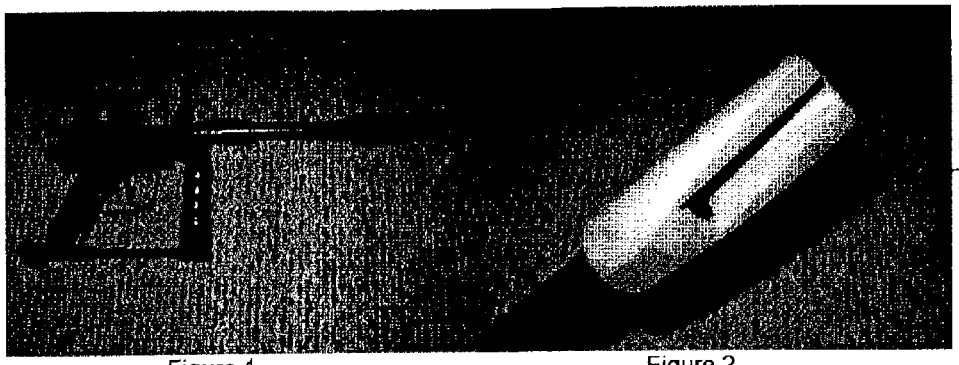
Figure 1
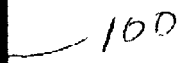
Figure 2
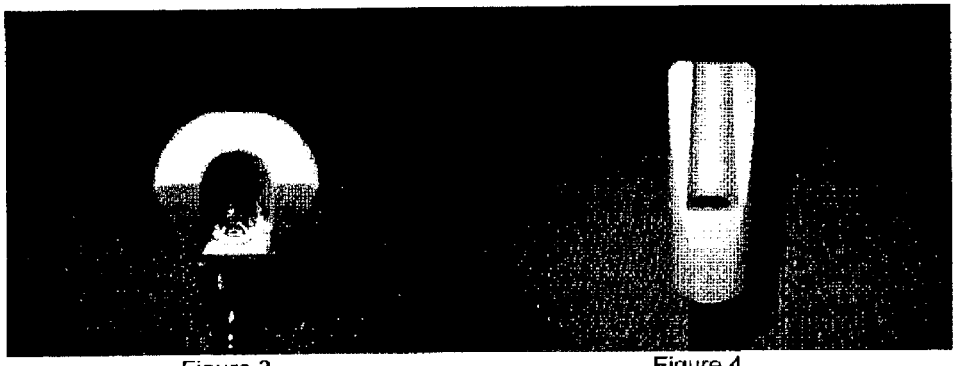
Figure 3
Figure 4
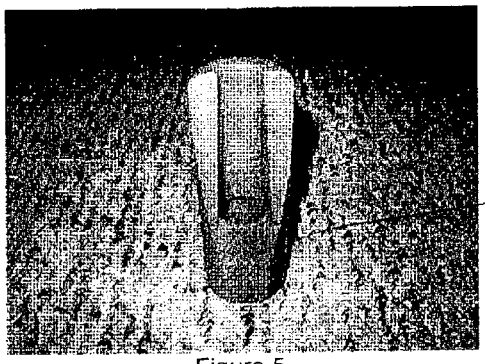
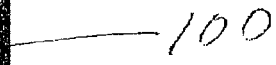
Figure 5

CROSS SECTION THROUGH CENTER OF DEVICE

CROSS SECTION THROUGH ADJUSTMENT GUIDE HOLE
(WITHOUT ADJUSTMENT PIN)

CROSS SECTION THROUGH ADJUSTMENT GUIDE HOLE
(ADJUSTMENT PIN INSTALLED)

PAINTBALL PROJECTILE DROP COMPENSATOR

RELATED APPLICATION

This application claims the benefit of priority pursuant to 35 USC 119 of provisional patent application Ser. No. 60/386,634 filed 05 Jun. 2002, the disclosure of which application is hereby incorporated in its entirety by reference herein.

FIELD OF THE INVENTION

The present invention relates generally to the paintball sporting game, and more specifically to an apparatus for improving paintball gun accuracy in hitting a target and improving the range and trajectory of a paintball fired through the apparatus.

BACKGROUND OF THE INVENTION

A paintball projectile delivered from a paintball gun is affected by gravity to a greater degree than an ordinary bullet because of the peculiar dynamic characteristics and relatively low velocity (<300 FPS) of the paintball when propelled from a paintball gun. One technique for improving delivery accuracy from the paintball gun is to deliberately produce a "backspin" to the paintball as it exits the barrel of the paintball gun.

Tippmann Pneumatics manufacturers a special barrel that is intended to induce a backspin to the paintball exiting the barrel of a paintball gun. This special barrel is intended to replace an existing barrel of one model of their paintball guns that they produce. More specifically, the special Tippmann Pneumatics barrel is curved from the chamber to a few inches out from the chamber. As the paintball goes through the curve portion of the barrel, it develops a backspin.

Another technique for deliberately producing "backspin" to the paintball as it exits the barrel of a paintball gun is incorporated into the paintball gun barrel as manufactured by Armson. In order to produce the backspin onto the paintball, Armson employs a straight barrel that has a swirled pattern on the inside surface of the barrel. This paintball barrel design by Armson is alleged to put a "top spin" on the paintball, which is supposed to make it travel farther.

Other examples, among others, of paintball guns and the like are taught in U.S. Pat. No. 5,823,173, U.S. Pat. No. 5,640,945, and U.S. Pat. No. 5,228,427 are herein incorporated by reference.

SUMMARY OF THE INVENTION

An object of the present invention is to provide a barrel attachment for a paintball gun to induce backspin onto a paintball as it travels from the paintball gun to a target.

Another object of the invention is to provide a barrel attachment for a paintball gun to induce backspin onto a paintball as it travels from the paintball gun to a target that may be applied to a wide variety of manufactured paintball guns.

Another object of the present invention is to provide a paintball backspin compensator that may be easily field adjustable to suit the needs and style of the paintball game player, and accommodate varying field conditions.

Another object of the present invention is to provide a paintball backspin compensator that may be easily adapted to accommodate and be tuned to various paintball diameters.

BRIEF DESCRIPTION OF THE DRAWINGS

FIG. 1 is a plan view of a paintball gun with the paintball drop compensator in accordance with the present invention.

FIG. 2 is a perspective view of the paintball drop compensator in accordance with the present invention.

FIG. 3 is a barrel end perspective view of the paintball drop compensator in accordance with the present invention.

FIG. 4 is top plan view of the paintball drop compensator in accordance with the present invention.

FIG. 5 a bottom perspective view of the paintball drop compensator in accordance with the present invention.

DETAILED DESCRIPTION OF THE INVENTION

Figure 7:
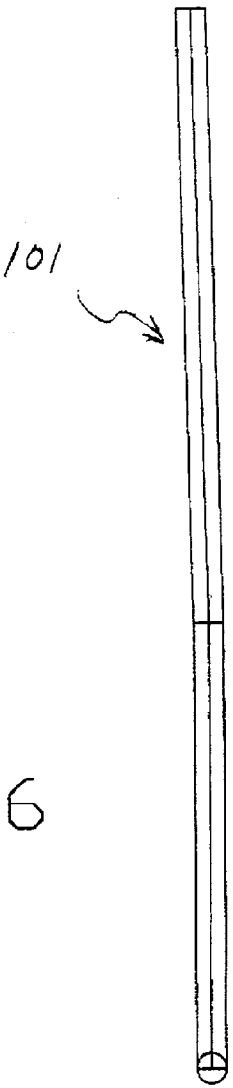
FIG. 7 a wire-line drawing of a pair of adjustment pins in accordance with one aspect of the present invention.
Figure 6:
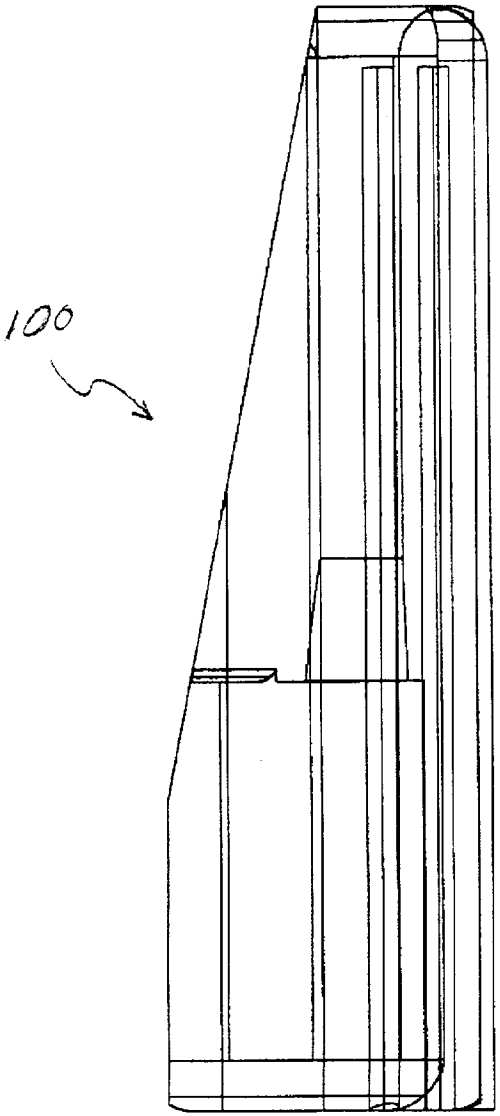
FIG. 6 a wire-line drawing of a side view of the paintball drop compensator in accordance with the present invention.
Figure 8:
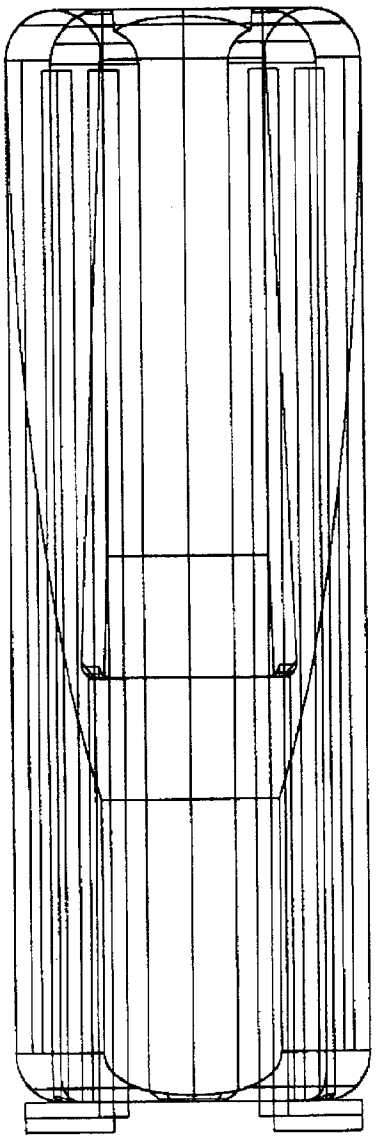
FIG. 8 a wire-frame drawing of a bottom plan view bottom view of the paintball drop compensator in accordance with the present invention.
Figure 10:
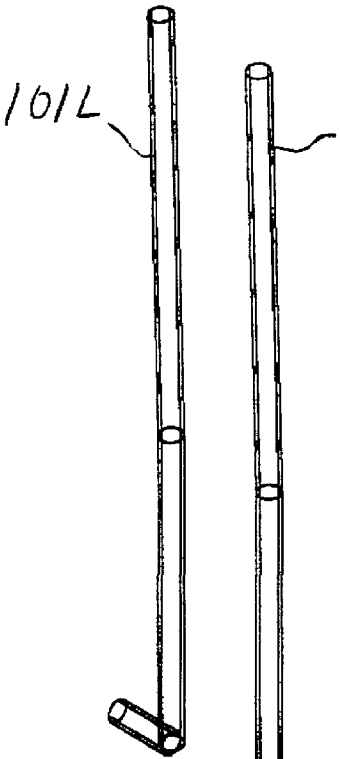
FIG. 10 a wire-frame drawing of a pair of adjustment pins in accordance with one aspect of the present invention.
Figure 9:
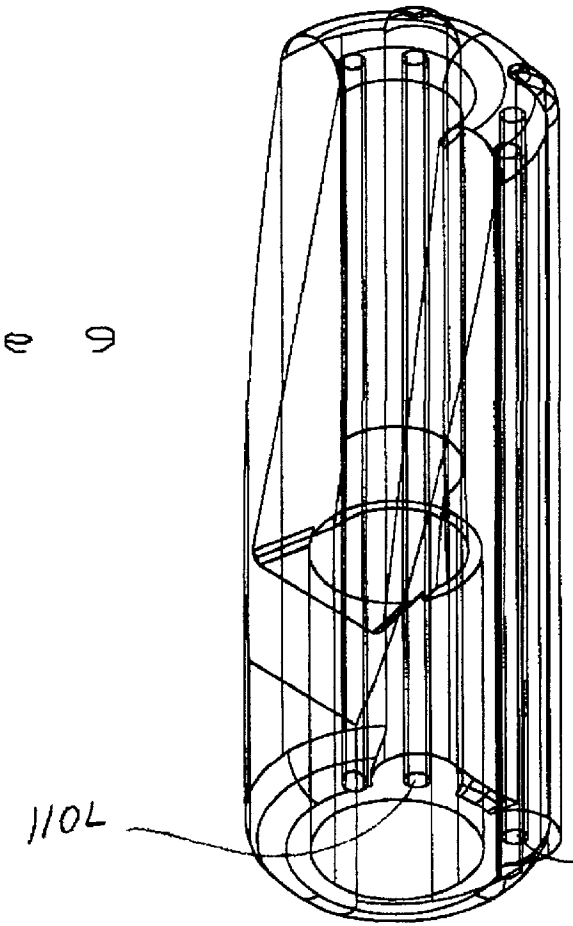
FIG. 9 a wire-frame drawing bottom perspective view of the paintball drop compensator in accordance with the present invention.
Figures 11, 12:
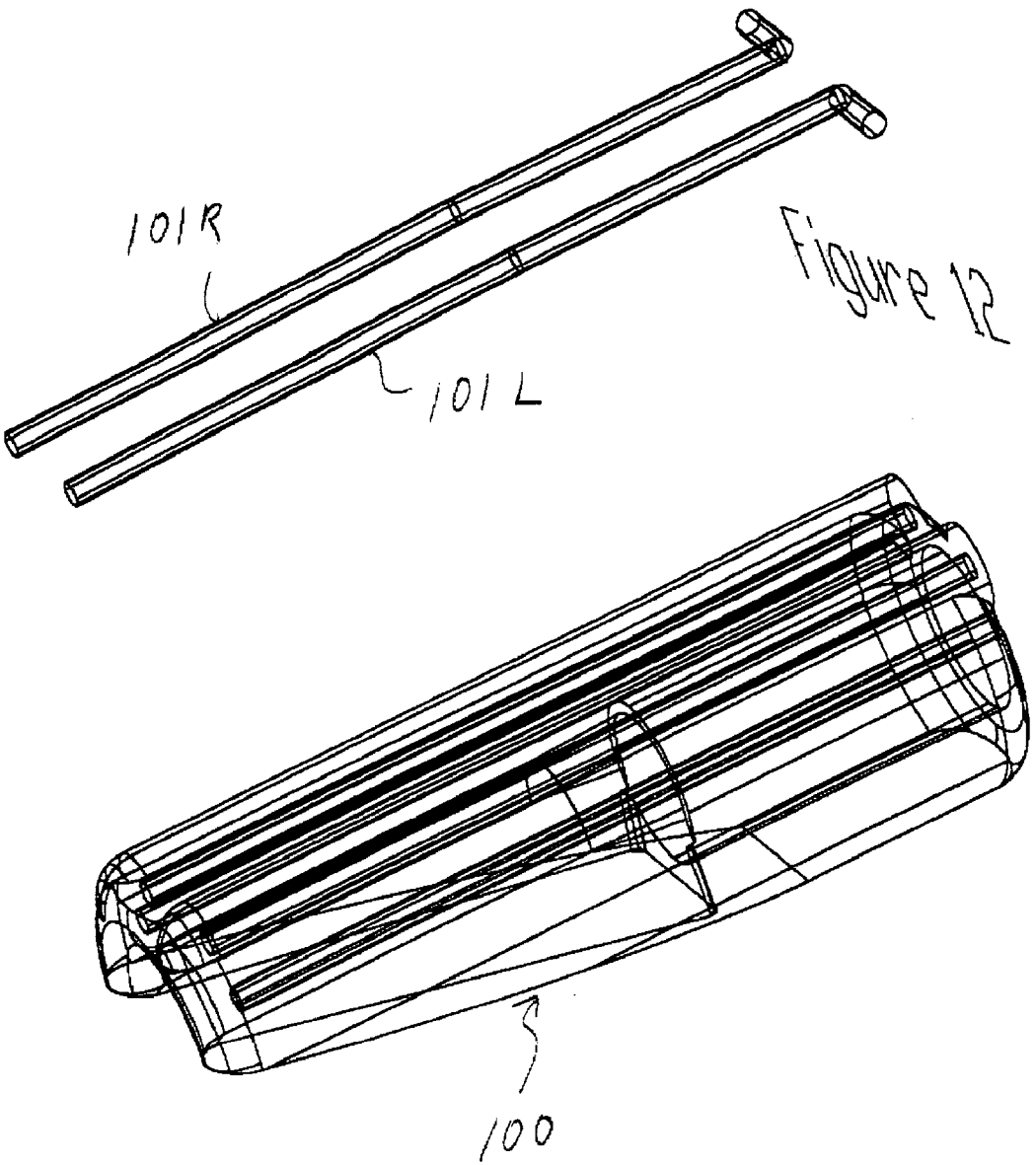
FIG. 11 a wire-frame drawing top perspective view of the paintball drop compensator in accordance with the present invention.
FIG. 12 a wire-line drawing of a pair of adjustment pins in accordance with one aspect of the present invention.
Figure 13:
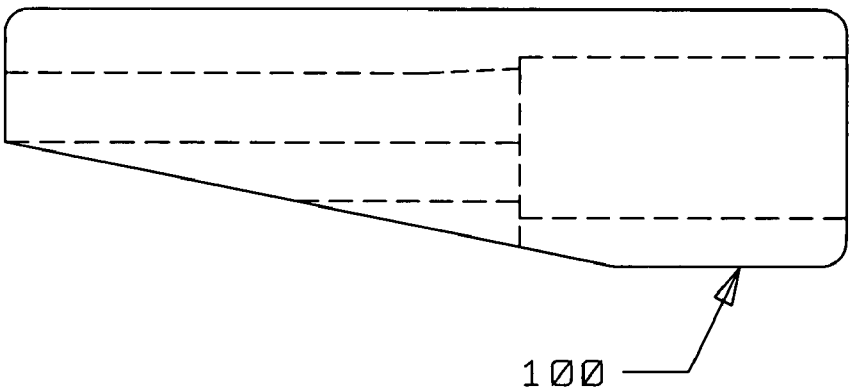
FIG. 13 a cross sectional view through the center of the paintball drop compensator in accordance with the present invention.
Figure 14:
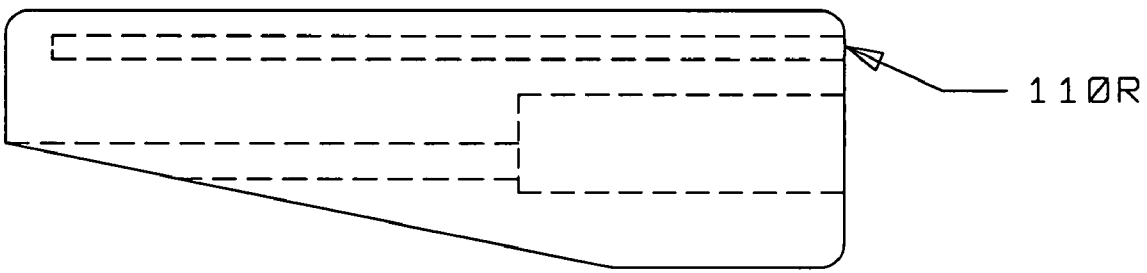
FIG. 14 a cross sectional view through the center of the guide hole for the adjustment pins—pins removed, of the paintball drop compensator in accordance with the present invention.
Figure 15:
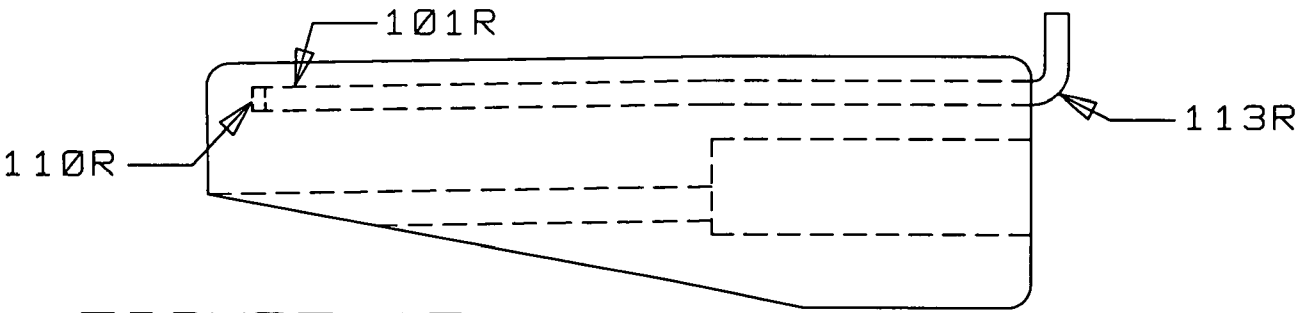
FIG. 15 a cross sectional view through the center of the guide hole for the adjustment pins—pins inserted, of the paintball drop compensator in accordance with the present invention.

The paintball drop compensator 100 or paintball barrel spin attachment of the present invention is particularly illustrated in FIGS. 1–5. FIG. 1 illustrates the barrel spin attachment affixed to an end of a common paintball gun barrel. The barrel spin attachment is preferably constructed of a pliable and resilient material for easy attachment to and removal from a paintball gun.

The exit portion of the barrel spin attachment is in the shaped of a longitudinally cleaved cylinder creating a "trough" that provides an inner surface intended to impart friction to a paintball passing there through. The "tough" is intended to be of the approximate diameter of the inside of the barrel (as shown in FIG. 3) and is generally aligned with the barrel, but with a slight angle relative to the longitudinal axis of the paintball gun barrel so that a paintball exiting the barrel will contact the inside surface of the trough as a paintball passes there through thereby imparting a back spin thereto. This contact causes friction between the paintball and the trough and causes the paintball to effectively "roll" down the trough. After the paintball has exited the barrel spin attachment, this roll or backspin causes lift on the paintball as it travels through the air. The lift experienced by the ball counteracts the natural drop due to gravity and causes the ball to have a very flat trajectory.

The aforementioned "slight angle" or bend of the trough relative to the gun barrel may be selected or adjusted to increase or decrease the amount of backspin put on the ball and to accommodate different paintball diameters.

In one embodiment of the invention the trough is tapered to further enhance the backspin in accordance with the present invention. In an exemplary embodiment of the adaptor in accordance with the present invention, the end of the trough nearest the barrel has a radius of 0.360 inches, and the exiting end has a radius of 0.340 inches.

In one embodiment of the invention, the adaptor is constructed from an elastomeric material. Of course, there are many materials that may be selected in order to provide the intended function. Further, the present invention may incorporate several materials in a laminate configuration. Also, the inner chamber or trough may also be patterned, more or less, to increase the friction between the paintball and the barrel spin attachment to enhance other paintball trajectory and dynamic characteristics.

In accordance with another aspect of the present invention, the choice of materials and design is such that the barrel spin attachment may be installed rotated to the axis of the barrel in accordance with the desires of the player. This characteristic is particularly important, since many paintball players like to hold their paintball gun tilted at an angle when shooting. In contrast, other known paintball guns with spin systems as already described intended to induce a backspin to the paintball forcibly need to be fired or shot with the gun body perpendicular to the ground or the paintball will curve in the direction the gun is tilted.

In accordance with another aspect of the present invention, the choice of materials and design is such that the barrel spin attachment may be either removed or disabled in less than 5 seconds if the player wants to shoot a paintball with a normal trajectory during a game (such as high wind conditions).

Figures 16A, 16B:
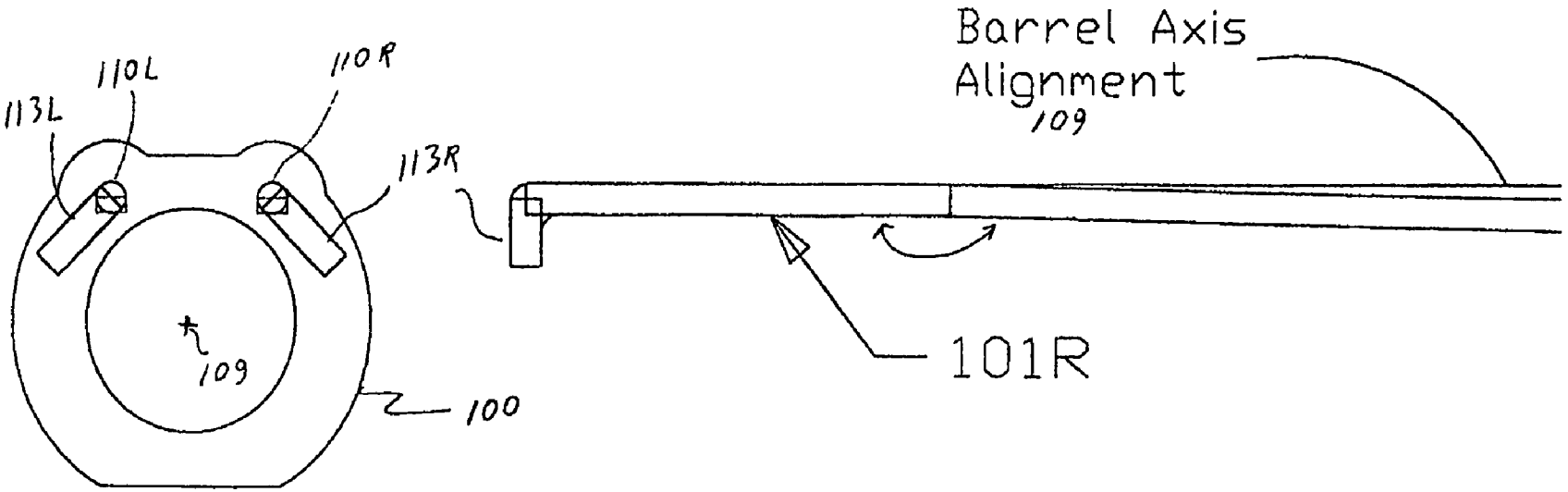
FIGS. 16*a–b* illustrates compensator adjustment pins relative to the barrel end of the compensator with the pins set in one position.
Figure 17B:
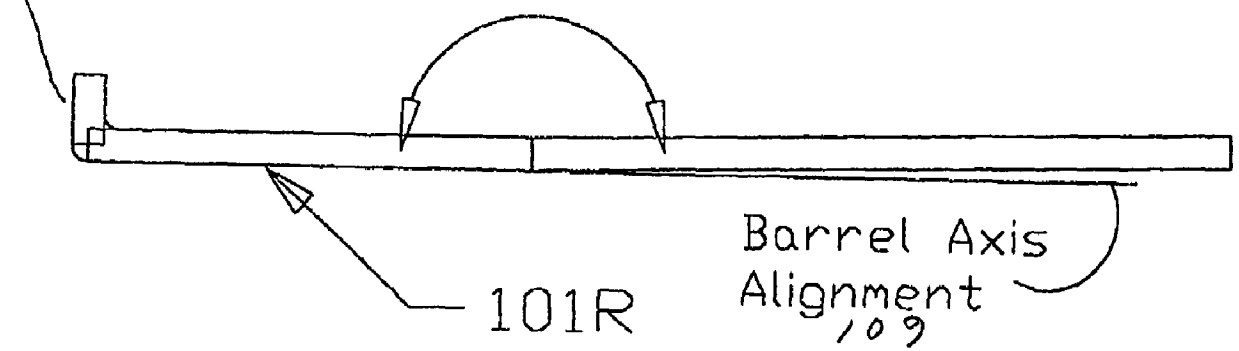
FIGS. 17*a–b* illustrates compensator adjustment pins relative to the barrel end of the compensator with the pins set in another position.
Figure 17A:
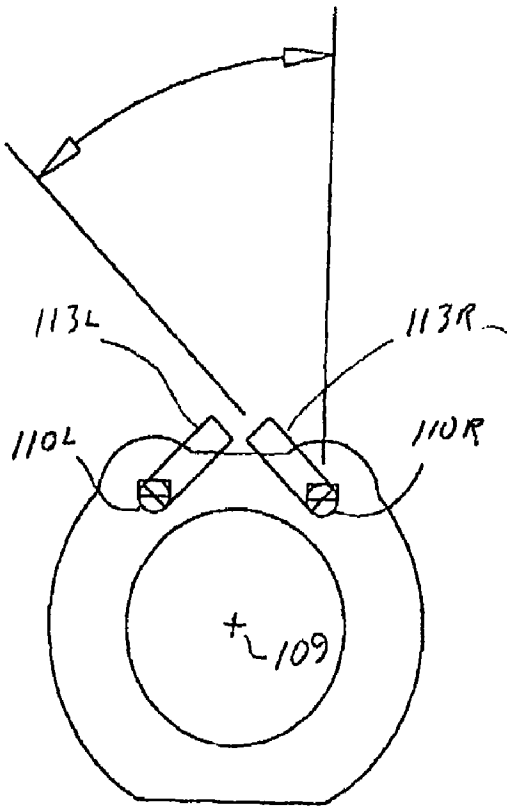

In accordance with another aspect of the present invention, the paintball drop compensator is provided with an adjustment mechanism to further enhance paintball trajectory by way of adjustment pins as illustrated in the drawings and more particularly by those exemplified in FIG. 16*a*, FIG. 17*a*. Longitudinal apertures 110L and 110R are preferably molded into the compensator for accommodating barrel adjustment pins 101L and 101R respectively. Pins 101L and 101R include lever handles 113L 113R respectively.

FIG. 16*a* illustrates the bends in the adjustment pin 101L-R relative to the body of the device (shown in third angle projection). As illustrated in FIG. 16*a*, with pins 101 inserted into the apertures 110, and with the left pin pointing at 135 degrees counter-clockwise from the upward position, and the right pin pointing at an 135 degrees clockwise from the upward position, both pins 101 are bent directly downward relative to the longitudinal axis of the barrel.

Similarly, as illustrated in FIG. 17*a*, with the left pin pointing at 45 degrees clockwise from the upward position, and the right pin pointing at 45 degrees counter-clockwise from the upward position, both the left pin 101L and right pin 101R bend pointing in an upward direction from the central axis of the compensator away from the longitudinal axis of the barrel. Angles shown are approximations and are for reference only.

Accordingly, adjustment of pins 101L-R provide an adjustment to the tapered portion of the drop compensator relative to the barrel axis for providing more or less backspin as desired to the paintball exiting the barrel of the paintball gun.

I claim:

1. A barrel spin attachment for a paintball gun to induce spin onto a paintball exiting the barrel of the paintball gun, the attachment comprising:

a structure having first and second end portions, said first portion including an aperture along a first longitudinal reference axis, where said first portion is securable over a barrel of a paintball gun;

the second portion opposite said first portion, forming an open split cylindrical cavity, wherein said split cylindrical cavity is positioned at an angle relative to a longitudinal axis of the paintball gun barrel such that a spin is imparted upon a paintball fired from said paintball gun barrel as it passes longitudinally through said split cylindrical cavity and exits there from; and at least one adjustment pin rotatable within, and extending through the aperture, the at least one adjustment pin bent relative to the longitudinal axis of the barrel.

2. The barrel spin attachment of claim 1 wherein an inner surface of said split cylindrical cavity is constructed from a material intended to impart spin onto said paintball as it passes longitudinally along said split cylindrical cavity.

3. The barrel spin attachment of claim 1 wherein said structure is constructed from an elastomeric material.

4. A barrel spin attachment for a paintball gun for inducing a spin onto a paintball exiting a barrel of the paintball gun, the attachment comprising:

a structure having first and second end portions, said first end portion having a cylindrical cross section and an aperture along a first longitudinal reference axis, said first end portion comprising a diameter sized to fit around a paintball gun barrel;

the second end portion, opposite said first end portion, comprising an open semi-cylindrical cavity, the open semi-cylindrical cavity comprising a diameter less than the diameter of the first end portion; and at least one adjustment pin rotatable within and extending through the aperture, the at least one adjustment pin bent relative to the longitudinal axis of the barrel.

5. The barrel spin attachment of claim 4, wherein the diameter of the open semi-cylindrical cavity is substantially equal to the diameter of a paintball.

6. The barrel spin attachment of claim 4, wherein said semi-cylindrical cavity is positioned at a slight angle relative to a longitudinal axis of the paintball gun barrel.

* * * * *